US005090754A

United States Patent [19]

Thompson

[11] Patent Number: 5,090,754

[45] Date of Patent: Feb. 25, 1992

[54] RESTRICTOR DEVICE WITH A RELEASABLE LATCH MEMBER

[75] Inventor: Peter J. Thompson, Greytown, New Zealand

[73] Assignee: Interlock Industries Limited, Miramar, New Zealand

[21] Appl. No.: 683,552

[22] Filed: Apr. 10, 1991

[30] Foreign Application Priority Data

Apr. 10, 1990 [NZ] New Zealand ..... 233276

[51] Int. Cl.[5] ..... E05C 17/34

[52] U.S. Cl. ..... 292/262; 292/263; 292/778

[58] Field of Search ..... 292/262, 263, 265, 268, 292/270, 274, 278, DIG. 5; 70/93

[56] References Cited

U.S. PATENT DOCUMENTS

| | | | |
|---|---|---|---|
| 3,796,072 | 3/1974 | Weeks | 70/93 |
| 4,048,822 | 9/1977 | Lüling | 70/93 |
| 4,086,727 | 5/1978 | Kuyper et al. | 292/263 |
| 4,206,939 | 6/1980 | Rowley, II | 292/263 |
| 4,257,632 | 3/1981 | De Stepheno | 292/263 |
| 4,318,559 | 3/1982 | Burton | 70/93 |
| 4,469,370 | 9/1984 | Petersen | 292/263 |
| 4,484,773 | 11/1984 | Lehne | 292/263 |
| 4,815,305 | 3/1989 | Smith | 70/93 |
| 4,923,232 | 5/1990 | Kawagoe et al. | 292/263 |
| 4,943,104 | 7/1990 | Zani et al. | 292/DIG. 5 |

FOREIGN PATENT DOCUMENTS

| | | | |
|---|---|---|---|
| 164522 | 12/1985 | European Pat. Off. | 292/263 |

*Primary Examiner*—Eric K. Nicholson

*Attorney, Agent, or Firm*—Oblon, Spivak, McClelland, Maier & Neustadt

[57] ABSTRACT

A restrictor device for restricting the extent of movement of a closure movably mounted with a frame. The restrictor device includes in combination an arm adapted for pivotal coupling to one of the closure member or frame and a latching member adapted for mounting with the other of the frame or closure member. The arm and latching members have cooperating elements which pivotally couple the arm with the latching member yet permits uncoupling of the arm from the latching member when the closure member is in a substantially predetermined position relative to the frame. The latching member includes a latch mechanism which prevents uncoupling of the arm when the closure is in the substantially predetermined position. There are operating mechanisms to enable the latch mechanisms to be operated such as to allow uncoupling of the arm to take place.

14 Claims, 4 Drawing Sheets

RESTRICTOR DEVICE WITH A RELEASABLE LATCH MEMBER

BACKGROUND OF THE INVENTION

1. Field of the Invention

This invention relates to a restrictor device which in use can selectively restrict the degree of movement of a closure which is movably mounted with a fixed frame.

2. Discussion of the Background

There are known hardware fittings which can be mounted between a fixture such as a window or door frame and closure such as a window or door such that the extent of movement of the window or door relative to the frame can be limited. An example of such a fitting is that sold under the Securistay trade mark and which is described and claimed in our New Zealand Patent Specification 188689. The Securistay fitting provides an effective means of limiting the opening of a window yet readily permits, once the latch arm has been released, the window to be opened wider for say cleaning purposes The latch arm automatically re-engages when the window is shut thereby limiting the extent to which the window can be re-opened. The arm can also be "locked" so that it can only be unlatched by authorized persons.

In use the Securistay product is not accessible from the outside of a window, however, it is mounted on the external surfaces of the interior of the window sash and frame thus is always visible. Being a utilitarian item of hardware it can distract from the aesthetics of the window. Also it has been found that in some situations such as in hotels etc. the device is often damaged by those endeavoring to open the window beyond its normal limited extent of opening. Such damage is normally caused by leverage or percussive forces and while these forces are not able to be rendered by someone located on the outside of the window (even when it is open to the limited extent allowed by the fitting) they can be readily applied to the fitting by a person inside the building. Such damage is often of such extent that the fitting becomes useless for the purpose for it was designed and in high rise applications a dangerous situation can arise whereby the extent of opening of the window can become unrestricted. As a result a person could fall through a window which has either been physically opened or sucked open in say high wind conditions.

SUMMARY OF THE INVENTION

An object of the present invention is thus to provide a restrictor device for restricting the extent of movement of a closure movably mounted with a frame, the device being able to be housed within a cavity formed by or between the closure and frame or in the closure or frame.

By being able to so house the restrictor device very little of the restrictor device is readily visible and as a result does not detract from the appearance of the window. In addition the device is not open to ready access by someone either within or outside the building and consequently the device is not readily able to be "forced" in the event that someone wishes to open the window beyond its limited extent of opening.

Broadly the invention provides a restrictor device for restricting the extent of movement of a closure movably mounted with a frame said restrictor device comprising in combination an arm adapted for coupling to one of the closure member or frame and a latching means adapted for mounting with the other of the frame or closure member, said arm and latching means having co-operating elements which pivotally couple said arm with the latching means but permits uncoupling of the arm from the latching means only when said closure member is in a substantially pre-determined position relative to said frame, said latching means having a latch member which prevents uncoupling of the arm when said closure is in the substantially predetermined position, there being operating means to enable said latch member to be operated such as to allow uncoupling of the arm to take place.

BRIEF DESCRIPTION OF THE DRAWINGS

In the more detailed description of the invention which follows reference will be made to the accompanying drawings in which.

DESCRIPTION OF THE PREFERRED EMBODIMENTS

Figure 1:
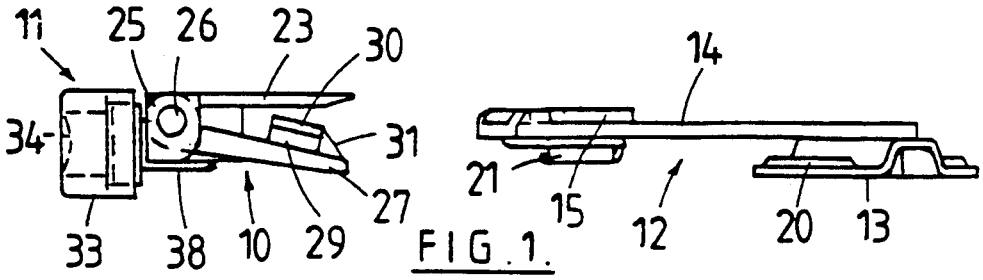
FIG. 1 is a side view of the restrictor device according to one form of the invention, the second portion of the arm being shown in the position as illustrated in dotted detail in FIG. 2.

The restrictor device can be used in both window and door applications and with windows and doors which are either hingedly coupled to the frame or slidingly mounted therewith. However, the device is primarily intended for use with windows which are hingedly mounted either in an awning or casement manner. In the following description therefore the device will be described in conjunction with a hinged window.

The device essentially comprises a latching device 10, an operating device 11 and an arm 12 which is pivotally coupled to a mounting plate 13. Arm 12 can be a single element but preferably is of articulated form comprising a first and second sections 14 and 15 pivotally coupled together by a pivot 16. A coil spring 17 is located at pivot 16 such that when second section 15 is released from the latching device 10 the second section 15 tends to pivot toward and locate substantially under first section 14.

First section 14 is itself pivoted coupled at 18 to mounting plate 13. Coil spring 19 biases arm 14 to pivot toward mounting plate 13 and essentially be aligned therewith. The reason for the spring loading of pivots !6 and 18 will become apparent from the following description.

Mounting plate 13 is formed with two openings 20 through which screws or other mechanical fasteners can be engaged to couple the mounting plate to a window sash.

Figure 2:
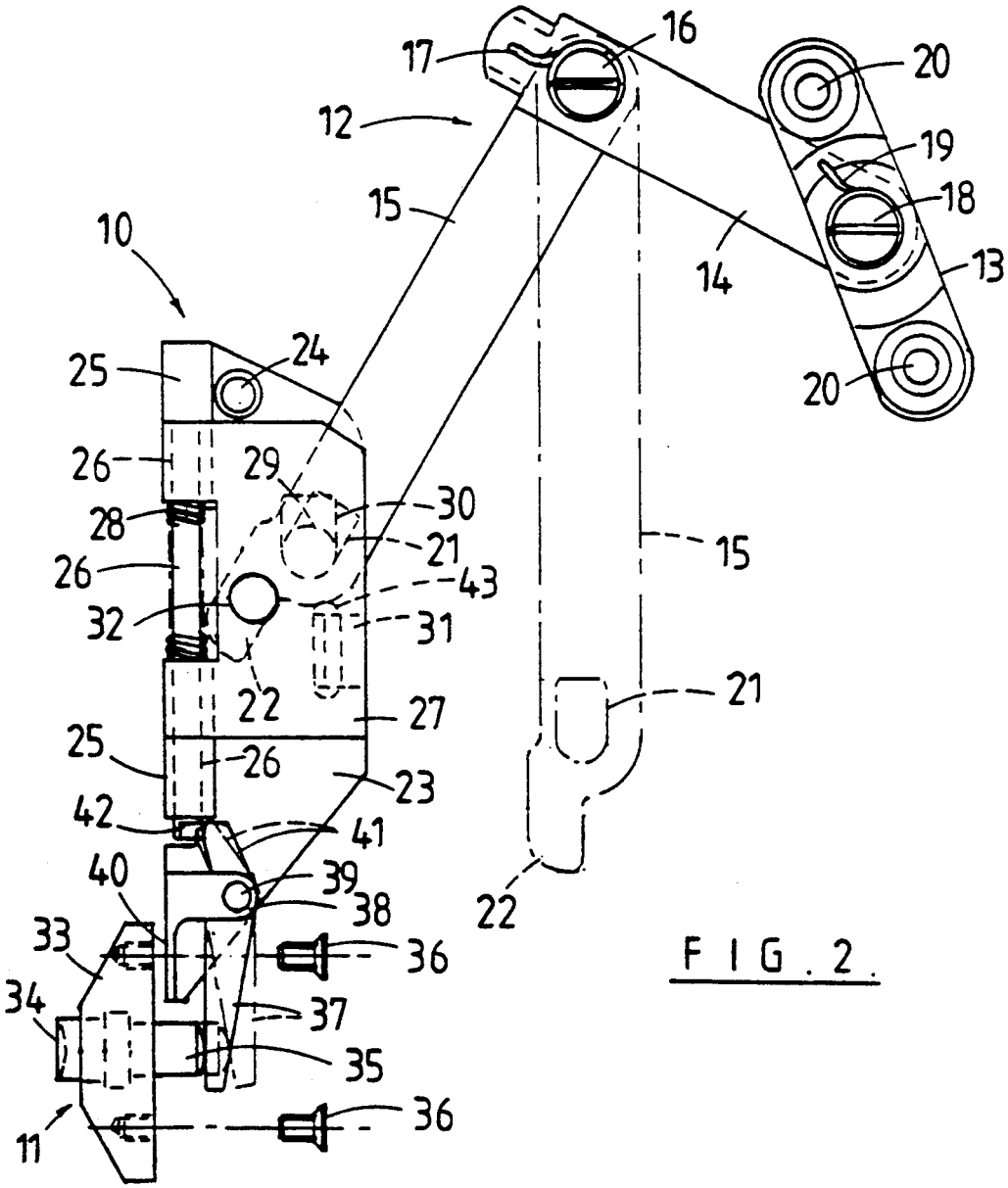
FIG. 2 is an elevation view of the restrictor device in the form shown in FIG. 1.

The outer end of arm section 15 has an aperture 21 which is generally of rectangular shape but with one short edge being curved (see dotted detail in FIG. 2). A projection 22 is formed at the extreme end of arm section 15.

Latching device 10 comprises a mounting plate 23 having apertures 24 whereby it can be mounted by mechanical fasteners to the window frame.

Mounting plate 23 has a pair of projecting lugs 25 having coaxial bores formed therein and through which passes a pin 26. A flap 27 is mounted with pin 26. A coil spring 28 is located in a cut out portion of flap 27 and provides a bias which causes flap 27 to be urged toward mounting plate 23.

On the underside of flap 27 there is provided a stud 29 of circular cross-section. This stud 29 provides a pivot pin for arm 15 as shown in FIG. 2. On the outer end of stud 29 is a flange 30 having the same shape but slightly less width and length than aperture 21 in arm 15. As shown in FIG. 2 arm 15 is pivotally coupled to the latching device 10 by aperture 21 being passed over flange 30 so that the pivot stud 29 is located within the confines of aperture 21.

The underside of flap 27 also carries a ramp 31 which extends away from the outer edge of flap 27.

Operating device 11 comprises a housing 33 which is adapted for mounting on an internal surface of the window frame. A plunger 35 is carried by housing 33 and at its outer end a finger engaging portion 34 is provided. Plunger 35 engages with a lever 37 which is pivoted to mounting plate 23 with a projection 38 extending from a flange 40 (which is essentially perpendicular to the plane of plate 23) being provided for this purpose. A pivot pin 39 extends through projection 38 and into a suitably positioned aperture in mounting plate 23.

A finger 41 coupled with lever 37 engages with a projection 42 attached to the end of pin 26.

Mechanical fastenings 36 are provided for mounting of the housing 33 these fastenings 36 passing through from the inside of the frame and thus are not readily accessible when the window is in the closed position. The inaccessibility of fasteners 36 is a feature which enhances the burglar proof nature of the restrictor device.

While plunger 34 is shown in its simplest form the plunger can be associated with a conventional barrel lock so that it can be key locked against movement.

To further describe the invention reference will now be made to the restrictor device in use. It will be appreciated that the latching device 10, arm 12 and mounting plate 13 will all be located within the cavity defined by the window sash and window frame. Thus with the window in the closed position arm sections 14 and 15 will be located one over the other and mounting plate 13 will be located essentially adjacent the latching device 10.

When the sash is moved toward an open position arm 12 will articulate as shown in FIG. 2. When the sash is opened to the position permitted by the restrictor device arm sections 14 and 15 will be substantially in the position shown. Thus full opening of the window is restricted by the restrictor device.

When it is desired to allow the window to be fully opened for say maximum ventilation or cleaning then the person opening the window can push knob 34 which causes plunger 35 to move inwardly and cause the lever 37 to move to the position as shown in dotted detail in FIG. 2. This movement is translated into a rotational movement of pin 26 which causes flap 27 to move away from mounting plate 23 as shown in FIG. 1. In the form of the invention shown cut outs are provided in mounting plate 23 to receive the upper extremity of ramp 31 and flange 30.

As the window is in the closed position when plunger 35 is moved flange 30 is aligned with opening 21 which causes the flange 30 to move through the aperture 21 and thereby free arm section 15. The window can therefore be opened to its full open position. When arm section 15 is released springs 17 and 19 cause the arms 14 and 15 to retract so as to be one above the other and essentially aligned with the mounting plate !3. Thus arm 12 is automatically retracted out of the way when released from the latching device 10.

Upon closing of the window, end 22 of arm section 15 comes into engagement with ramp 31 which causes the flap 27 to be pivoted away from mounting plate 23 and thereby allow arm section 15 to move into a position where aperture 21 is once again aligned with flange 30. When this occurs spring 28 once again causes flap 27 to move back to its normal position whereupon flange 30 passes through aperture 21 and automatically recouples arm section 15 with latching device 10. Thus when the window is reopened it will only be able to open to the restricted degree of opening allowed by arm 12 unless prior to such opening plunger 35 has once again been reactivated.

The restrictor device can have many forms within the scope of the invention. One further embodiment is thus illustrated in FIGS. 3 to 6. For convenience, equivalent components have the same reference numerals as used in describing the first embodiment.

To further describe the second embodiment, reference will be made to the operation thereof.

Figures 3, 4:
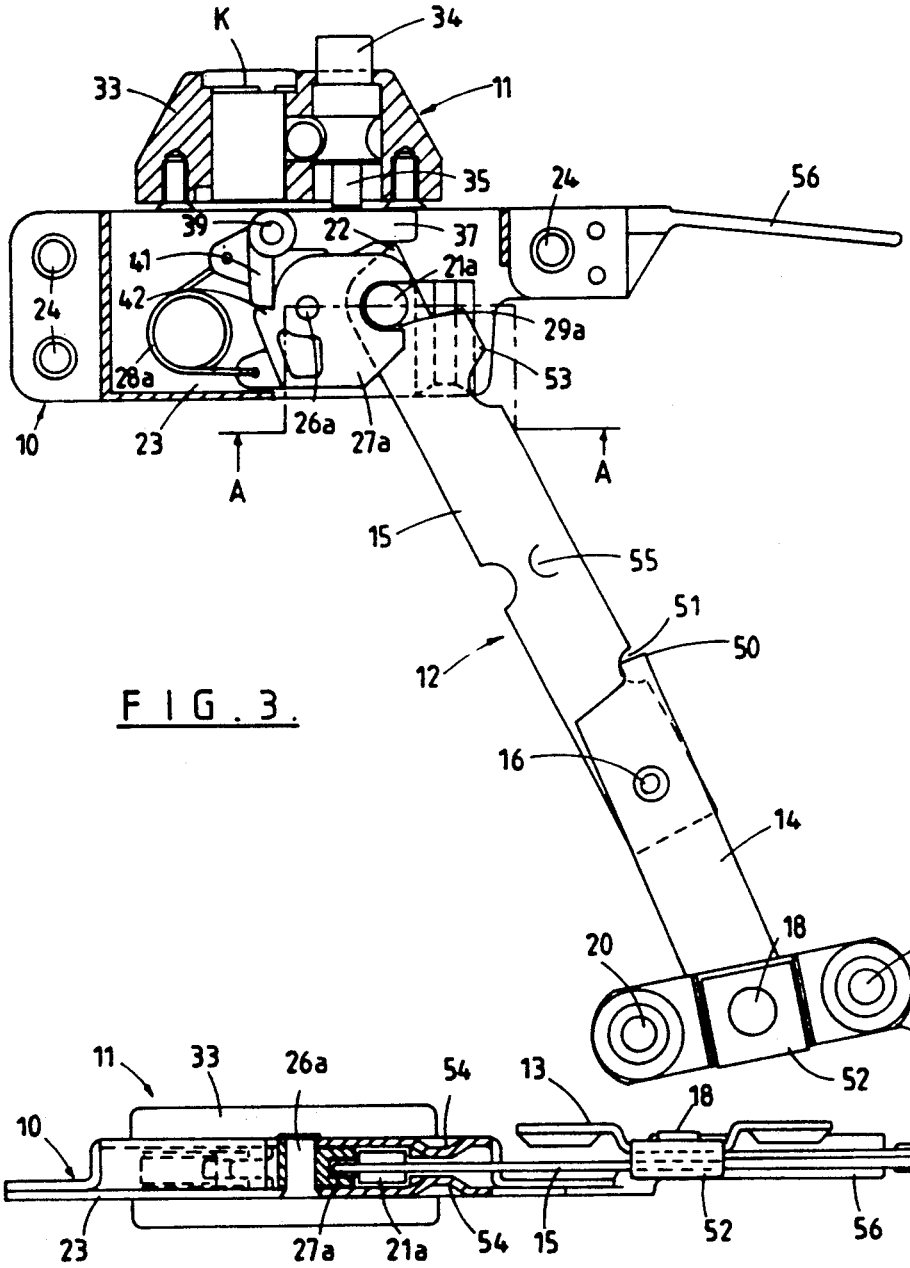
FIG. 3 is a view of the restrictor device according to a further form of the invention when in the fully restricting position.
FIG. 4 is a elevation view taken along sectional line A—A of FIG. 3.

In FIG. 3, the device is shown in the operative restricting configuration with the keylock K locked. Accordingly stud 21*a* (which projects from either side of arm 15) is engaged within aligned open ended slots 29*a* of the blades of the latch plate 27*a*. The latch plate 27*a* is prevented from pivotal movement about pivot 26*a* due to finger 41 engaging with projection 42 of the latch plate 27*a*. Also lever 37 is prevented from full movement about pivot 39 by end 22 of arm section 15. Thus if the closure is open and keylock K is unlocked, plunger 35 is still unable to undergo full movement.

Figure 5:
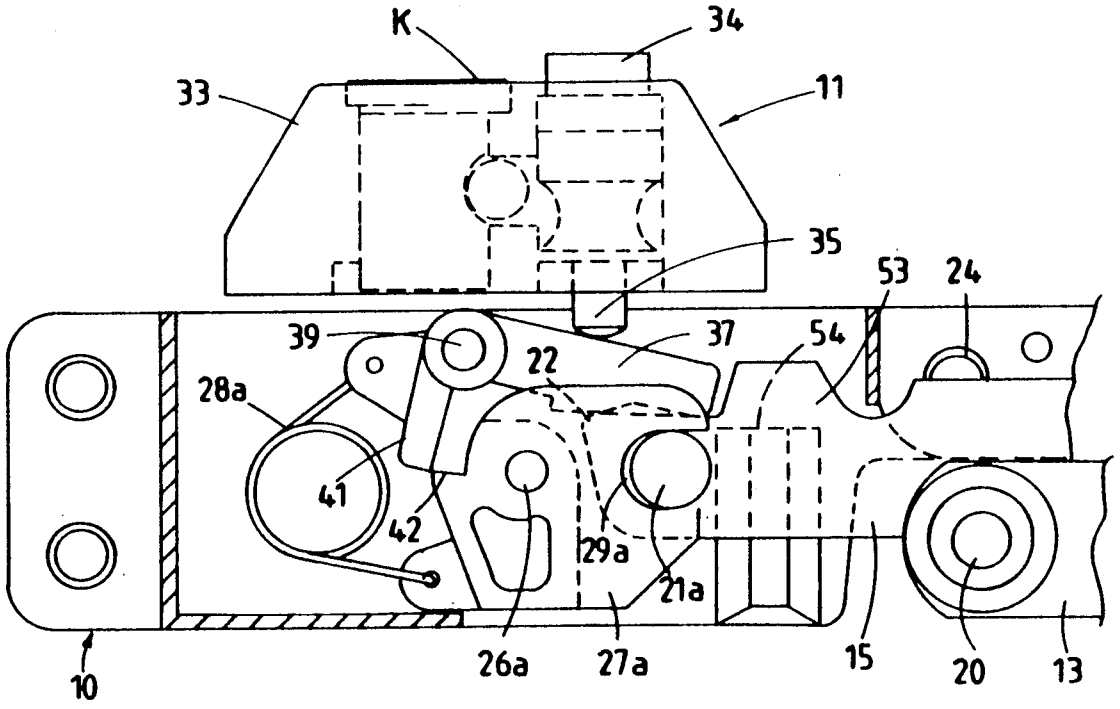
FIG. 5 is a partial elevation view of the restrictor device at the point of just becoming unlatched.

When in the fully opened position, stop 50 on arm 14 engages in cut out 51 of arm 15 to prevent the arms from going over center. This ensures easy closure of the arms. Referring now to FIG. 5, the device is in the position when the window is closed and the keylock K has been unlocked. End 22 of arm 15 is in such a position that it does not prevent lever 37 from pivoting. Thus plunger 35 can be moved inwardly so as to pivot lever 37 thereby releasing finger 41 from projection 42. Consequently when the window sash is opened, spring 28*a* acts on latch plate 27*a* to pivot it to the position shown in FIG. 6 whereby stud 21*a* becomes released and the window sash can be moved to any open position beyond the angle which would normally be restricted by the device.

It will be noted that lever 37 almost contacts tip 22 of arm 15 at opening and consequently a small rotation of arm 15 will prevent unlocking. Also, if button 34 is insufficiently depressed, then movement of the sash would cause arm 15 to rotate and contact lever 37. Further opening of the sash would result in lever 37 being pushed back to the fully locked position effectively re-locking when incorrectly operated.

It will be appreciated that spring 28*a* always acts to rotate the latch plate 27*a* clockwise and the lever 37 anti-clockwise.

Figure 6:
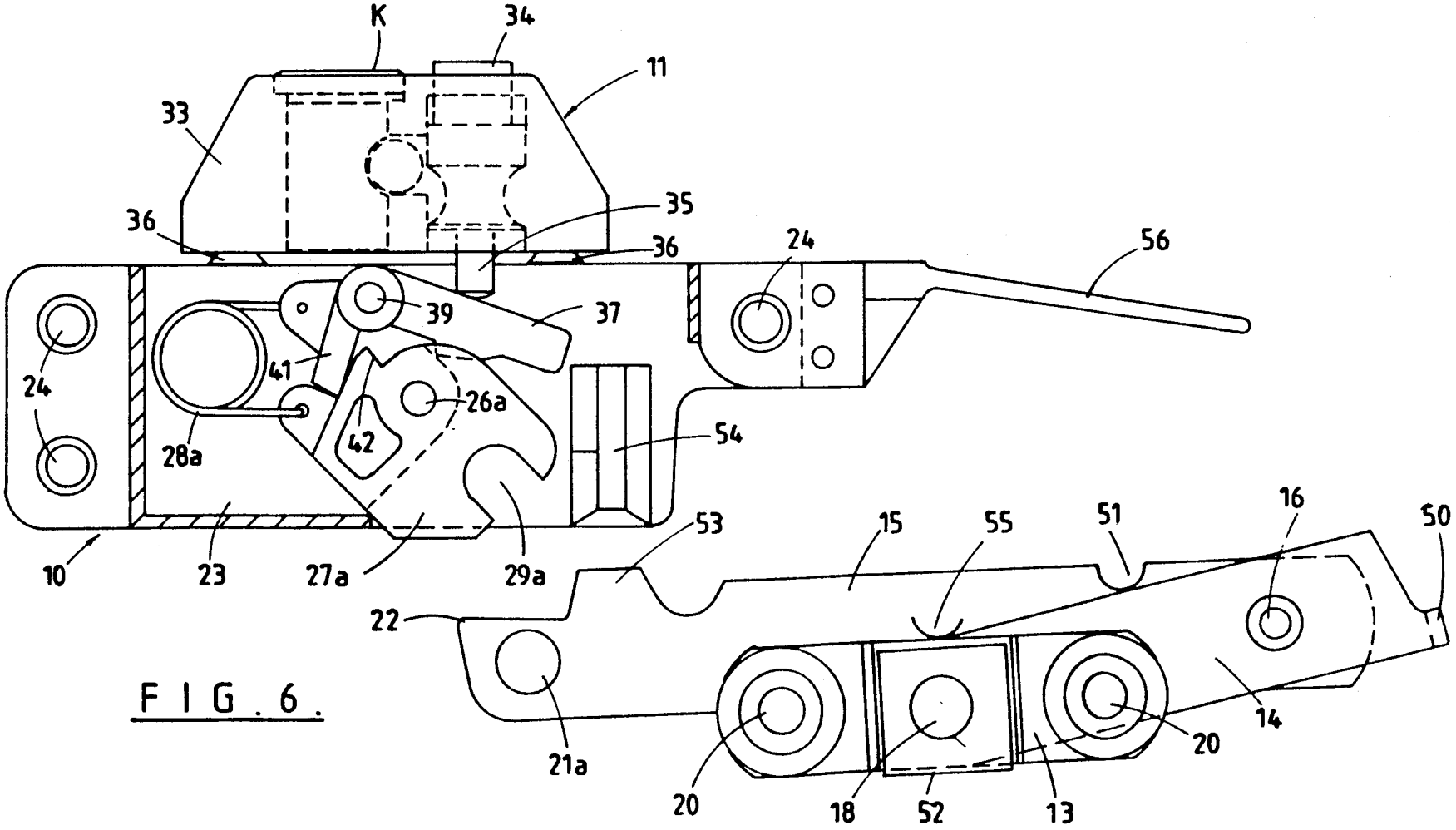
FIG. 6 is a partial elevation view showing the device in the free or unlatched state.

FIG. 6 shows the restrictor device in the free to open or unlocked state. In such state, the latch plate 27*a* and lever 37 remain in the unlocked state regardless of the actuator 11. The arms 14 and 15 are effectively held in a "retracted" position by a retaining clip 52 which grips arm 15.

Upon closing of the window sash, a guide 53 on arm 15 engages between ramps 54 and aligns arm 15 to engage with latch plate 27*a*. Also stop 55 on arm 15 and a closing stop 56 force arm 15 to align to ensure locking of the latch. This closing stop 56 is sufficiently flexible to provide a location tolerance and over closing of the lock, thereby allowing for variations with window seals etc.

Further modifications to the restrictor device can include the actuator having a child-proof push button or a different type of key locking system. Different installations for different end uses may require specific designs of actuator. Thus, for example, the actuator could be remotely situated or a sliding lever, button arrangement could be used. According to a still further modification, a single arm in place of articulated arms 14 and 15 could be used, however, in such an arrangement the single arm would be pivoted on a slide engaged to slidingly move on mounting 13.

The restrictor device according to the present invention is of a straight forward yet extremely effective construction and is one which can be located within a cavity such that only the operating mechanism 11 is visible when the window is in the fully closed position. Even when the window is opened to the full limit allowed by the restrictor device the retracted articulated arm is not readily accessible to leverage or percussive forces. When operating device 11 incorporates a key lock or a key lockable plunger it is believed that the readily visible lock or at least keyhole will indicate that release of the arm is only possible by use of a key. Thus it is believed that the instances of force being used in an effort to release the arm will be reduced.

It is also believed that the restrictor device is essentially burglar proof in that even in the retracted open position unauthorized entry cannot be achieved by tampering with the mounting screws for the restrictor device 10 or mounting plate 13.

When the invention is used in a door application it may be a requirement that a Cavity, in the form of a rebate, be formed in the lock edge of the door and possibly the door surround. Once again the restrictor device 10 will be mounted with the door frame and the mounting plate 13 located on or in a rebate in the lock edge of the door. When arm 12 is released it will automatically retract into a cavity or against the lock edge of the door so as to be out of the way.

It is envisaged that when the invention is used in a door application the operating means 11 will be modified such that, with for example the first embodiment, the flap 27 can be held away from mounting plate 23 so as to prevent relatching of the arm taking place every time the door is closed. The restrictor device when used with a door application will essentially therefore be used in the manner of a security device which is activated only when the user requires security such as at night time.

What is claimed is:

1. A restrictor device for restricting the extent of movement of a closure movably mounted with a frame, the restrictor device comprising in combination:

an arm adapted for coupling to one of the closure member or frame, latching means adapted for mounting with the other of the frame or closure member, a latch element included with said latching means, said latch element coupling said arm to the latching means, said latch element being mounted for movement to a release position to enable the arm to be released from its coupling with the latch element, a latch member which is operative such that the latch element can move to said release position, operating means associated with said latch member to enable said latch member to be operated, and restriction means for preventing said latch element from moving to said release position except when said arm is in a substantially predetermined position relative to said latching means.

2. The restrictor device of claim 1 wherein said arm and latch element have cooperating means which, when said arm has been released and is caused to return to said substantially predetermined position, cooperate to cause the latch element to move and recouple said arm with said latching means.

3. The restrictor device of claim 2 wherein the arm comprises an articulated arm.

4. The restrictor device of claim 3 which comprises means for maintaining said arm in a retracted state when said arm has been released from said latching means.

5. The restrictor device of claim 1 wherein the cooperating means comprises a projection from the latch element and a shaped opening at or near the free end of the arm, said restriction means being formed by the projection having a correspondingly shaped flange which, for enabling release of the arm from the latching means, can only pass through said opening when the closure is in said substantially predetermined position.

6. The restrictor device of claim 2 wherein the cooperating means comprises a projection from the latch element and a shaped opening at or near the free end of the arm, said restriction means being formed by the projection having a correspondingly shaped flange which, for enabling release of the arm from the latching means, can only pass through said opening when the closure is in said substantially predetermined position.

7. The restrictor device of claim 1 wherein the latch member is mounted so as to be movable from a locking position for preventing movement of the latch element to a release position and an unlocked position where the latch element is movable to said release position.

8. The restrictor device of claim 2 wherein the latch member is mounted so as to be movable from a locking position for preventing movement of the latch element to a release position and an unlocked position where the latch element is movable to said release position.

9. The restrictor device of claim 7 wherein the cooperating means comprises the latch element having an open ended slot and the arm having a projection at or near the free end thereof, and said restriction means comprises an engagement portion formed with said arm which restricts said latch member from at least being fully operable except when said closure is in said substantially predetermined position.

10. The restrictor device of claim 9 wherein the latch member comprises a pivotally mounted lever which cooperates with said operating means, said lever including a finger which engages with a part of the latch element when said lever is in the locking position.

11. The restrictor device of claim 10 wherein the operating means include an engagement element which engages with said lever, said engagement element being movably mounted for moving said lever from said locking position to said unlocked position.

12. The restrictor device of claim 11 wherein the engagement element comprises a plunger one end of which engages with said lever and the other end of which comprises a manually operable operating portion.

13. The restrictor device of claim 12 wherein the operating means is key lockable.

14. In a window construction comprising a window sash movably located within a window frame wherein a cavity is formed between said sash and frame when the sash is in the closed position, a restrictor device for restricting the extent of opening movement of the sash, the restrictor device being located within the cavity and comprising in combination:

an arm adapted for coupling to one of the closure member or frame, latching means adapted for mounting with the other of the frame or closure member, a latch element included with said latching means, said latch element coupling said arm to the latching means, said latch element being mounted for movement to a release position to enable the arm to be released from being coupled with the latch element, a latch member which is operative such that the latch element can move to said release position, operating means associated with said latch member to enable said latch member to be operated, and restriction means for preventing said latch element from moving to said release position except when said arm is in a substantially predetermined position relative to said latching means, said operating means having a portion which is accessible externally of the cavity.

* * * * *